US011371380B2

(12) United States Patent
Poick

(10) Patent No.: US 11,371,380 B2
(45) Date of Patent: Jun. 28, 2022

(54) VARIABLE GUIDE VANE ASSEMBLY AND VANE ARMS THEREFOR

(71) Applicant: PRATT & WHITNEY CANADA CORP., Longueuil (CA)

(72) Inventor: Daniel Poick, Brampton (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/108,937

(22) Filed: Dec. 1, 2020

(65) Prior Publication Data

US 2022/0170381 A1 Jun. 2, 2022

(51) Int. Cl.
*F01D 17/16* (2006.01)
*F01D 9/04* (2006.01)

(52) U.S. Cl.
CPC ..... *F01D 17/162* (2013.01); *F01D 9/041* (2013.01); *F01D 9/042* (2013.01); *F05D 2240/128* (2013.01); *F05D 2260/50* (2013.01); *F05D 2300/603* (2013.01)

(58) Field of Classification Search
CPC ..... F01D 17/162; F01D 9/041; F01D 9/042; F05D 2240/128; F05D 2260/50; F05D 2300/603
See application file for complete search history.

(56) References Cited

U.S. PATENT DOCUMENTS

| | | | | |
|---|---|---|---|---|
| 4,035,101 | A * | 7/1977 | Glenn | F01D 17/162 415/160 |
| 4,741,666 | A | 5/1988 | Shimizu et al. | |
| 5,215,434 | A | 6/1993 | Greune et al. | |
| 6,699,010 | B2 * | 3/2004 | Jinnai | F01D 17/16 415/164 |
| 6,779,971 | B2 | 8/2004 | Garrett | |
| 6,984,105 | B2 | 1/2006 | Clark et al. | |
| 7,186,077 | B2 | 3/2007 | Daudel et al. | |
| 7,273,346 | B2 | 9/2007 | Bouru | |
| 7,300,245 | B2 | 11/2007 | Bouru | |

(Continued)

FOREIGN PATENT DOCUMENTS

| | | |
|---|---|---|
| CN | 201228563 | 4/2009 |
| CN | 201460998 | 5/2010 |

(Continued)

*Primary Examiner* — Michael Lebentritt
*Assistant Examiner* — Brian Christopher Delrue
(74) *Attorney, Agent, or Firm* — Norton Rose Fulbright Canada LLP

(57) ABSTRACT

A variable guide vane (VGV) assembly for a gas turbine engine has: vanes distributed about a central axis and having airfoils between stems at respective ends of the airfoils; a unison ring; sliders protruding from the unison ring; and vane arms engaged to first stems and defining respective slots, each of the slots extending in a direction having a radial component relative to a respective one of the spanwise axes, the sliders received within respective ones of the slots, a slot extending from a proximal end to a distal end along a slot axis, the vane arm defining the slot having an end wall at the distal end, the end wall extending in a direction having a component transverse to the slot axis such that a slider abuts against the end wall when the slider is at the distal end to prevent the sliders from moving out of the slots.

20 Claims, 4 Drawing Sheets

(56) References Cited

U.S. PATENT DOCUMENTS

| | | | | |
|---|---|---|---|---|
| 7,322,790 | B2 * | 1/2008 | Bouru | F01D 17/162 415/162 |
| 9,200,640 | B2 | 12/2015 | Patil | |
| 9,429,033 | B2 | 8/2016 | Martin et al. | |
| 9,644,491 | B2 | 5/2017 | Zhou et al. | |
| 9,784,117 | B2 | 10/2017 | Duguay et al. | |
| 9,784,365 | B2 | 10/2017 | Marshall et al. | |
| 9,790,949 | B2 | 10/2017 | Tashiro et al. | |
| 10,006,332 | B2 | 6/2018 | Kuma | |
| 10,415,596 | B2 * | 9/2019 | Suciu | F01D 17/162 |
| 2010/0092278 | A1 * | 4/2010 | Major | F01D 17/162 415/160 |
| 2010/0150701 | A1 | 6/2010 | Simon et al. | |
| 2015/0016968 | A1 | 1/2015 | Grabowska et al. | |
| 2015/0086340 | A1 | 3/2015 | Ramb et al. | |
| 2015/0361820 | A1 | 12/2015 | Zhou et al. | |
| 2016/0230586 | A1 | 8/2016 | King et al. | |
| 2016/0298534 | A1 | 10/2016 | Lotz | |
| 2016/0356178 | A1 * | 12/2016 | Do | F01D 25/16 |
| 2017/0226888 | A1 | 8/2017 | Howell | |
| 2018/0313222 | A1 * | 11/2018 | Mena Dominguez | B60S 1/02 |

FOREIGN PATENT DOCUMENTS

| | | | | | |
|---|---|---|---|---|---|
| CN | 201474729 | | | 5/2010 | |
| CN | 201884075 | U | | 6/2011 | |
| CN | 201884076 | | | 6/2011 | |
| CN | 202348349 | U | | 7/2012 | |
| CN | 202370599 | | | 8/2012 | |
| CN | 203584478 | | | 5/2014 | |
| CN | 103089344 | | | 6/2015 | |
| CN | 105626164 | | | 8/2017 | |
| CN | 207728436 | | | 8/2018 | |
| CN | 108825362 | | | 11/2018 | |
| EP | 0909880 | A2 | * | 4/1999 | F01D 17/162 |
| GB | 880903 | | | 10/1961 | |
| GB | 2400416 | A | | 10/2004 | |
| GB | 2400633 | | | 10/2004 | |
| GB | 2550957 | A | * | 12/2017 | F04D 29/563 |
| JP | 03714041 | B2 | | 11/2005 | |
| JP | 4044392 | | | 2/2008 | |
| JP | 2010065591 | A | | 3/2010 | |
| JP | 05071421 | | | 11/2012 | |
| WO | 1999050533 | | | 10/1999 | |
| WO | WO2015026654 | A1 | | 2/2015 | |
| WO | 2016059300 | | | 4/2016 | |

* cited by examiner

VARIABLE GUIDE VANE ASSEMBLY AND VANE ARMS THEREFOR

TECHNICAL FIELD

The disclosure relates generally to gas turbine engines, and more particularly to variable guide vanes assemblies as may be present in a compressor section and/or a turbine section of a gas turbine engine.

BACKGROUND OF THE ART

In a gas turbine engine, air is pressurized by rotating blades within a compressor, mixed with fuel and then ignited within a combustor for generating hot combustion gases, which flow downstream through a turbine for extracting energy therefrom. Within the compressor of the engine, the air is channeled through circumferential rows of vanes and blades that pressurize the air in stages. Variable guide vanes (VGVs) are sometimes used within compressors and/or turbines, and provide vanes which are rotatable such that an angle of attack they define with the incoming flow may be varied. Improvements with such variable guide vane assemblies is sought.

SUMMARY

In one aspect, there is provided a variable guide vane (VGV) assembly for a gas turbine engine, comprising: variable guide vanes circumferentially distributed about a central axis, the variable guide vanes having airfoils extending between first and second stems at respective first and second ends of the airfoils, the variable guide vanes rotatable about respective spanwise axes; a unison ring rotatable about the central axis; sliders protruding from the unison ring and circumferentially distributed around the central axis; and vane arms engaged to the first stems of the variable guide vanes, the vane arms defining respective slots, each of the slots extending in a direction having a radial component relative to a respective one of the spanwise axes, the sliders received within respective ones of the slots, a slot of the slots extending from a proximal end adjacent a corresponding one of the first stems to a distal end along a slot axis, the slot defined by a vane arm of the vane arms, the vane arm having an end wall at the distal end of the slot, the end wall extending in a direction having a component transverse to the slot axis such that a slider of the sliders is in abutment against the end wall when the slider is at the distal end to prevent the sliders from moving out of the slots.

In some embodiments, the slider is movable along the slot axis from a first position in which the slider is between the proximal and distal ends and a second position in which the slider is at the distal end in contact against the end wall and in which further movements of the slider away from the proximal end are blocked by the end wall.

In some embodiments, the slot is fully enclosed by a peripheral wall of the vane arm, the peripheral wall including the end wall.

In some embodiments, the peripheral wall defines two opposite guiding walls, the slider in contact with the two opposite guiding walls between the proximal and distal ends of the slot.

In some embodiments, a distance between the two opposite guiding walls corresponds to a diameter of the slider.

In some embodiments, the vane arms are made of a composite material.

In some embodiments, the slot of the vane arm includes all of the slots of the vane arms.

In another aspect, there is provided a gas turbine engine, comprising: an annular gaspath extending around a central axis, the annular gaspath defined between a first casing and a second casing; and a variable guide vane assembly having variable guide vanes circumferentially distributed about a central axis, the variable guide vanes having airfoils extending between first and second stems at respective first and second ends of the airfoils, the variable guide vanes rotatable about respective spanwise axes, a unison ring rollingly engaged to the first casing for rotation about the central axis, sliders protruding from the unison ring and circumferentially distributed around the central axis, and vane arms engaged to the first stems of the variable guide vanes, the vane arms defining slots, each of the slots extending in a direction having a radial component relative to a respective one of the spanwise axes, the sliders engaged to the vane arms by being received within the slots, a slot of the slots being substantially enclosed by a peripheral wall of a respective vane arm, the sliders prevented from exiting the slots via an abutment between a slider of the sliders and the peripheral wall at a distal end of the slot of the vane arm.

In some embodiments, the slot is entirely circumscribed by the peripheral wall of the vane arm.

In some embodiments, the peripheral wall defines two opposite guiding walls, the slider in contact with the two opposite guiding walls between a proximal end of the slot and the distal end of the slot.

In some embodiments, the first casing is located radially outwardly of the second casing relative to the central axis.

In some embodiments, the vane arms are made of a composite material.

In some embodiments, the slot of the vane arm includes all of the slots of the vane arms.

In yet another aspect, there is provided a variable guide vane (VGV) assembly for a gas turbine engine, comprising: variable guide vanes circumferentially distributed about a central axis, the variable guide vanes having airfoils extending between first and second stems at respective first and second ends of the airfoils, the variable guide vanes rotatable about respective spanwise axes, a unison ring rollingly engageable to a casing of the gas turbine engine for rotation about the central axis; sliders protruding from the unison ring and circumferentially distributed around the central axis; and vane arms secured to the first stems of the variable guide vanes, the vane arms defining slots, each of the slots extending in a direction having a radial component relative to a respective one of the spanwise axes, the sliders engaged to the vane arms by being received within the slots, a vane arm of the vane arms having means for preventing the sliders from exiting the slots of the vane arms.

In some embodiments, the means include an end wall of the vane arm at a distal end of a slot of the slots, the end wall extending transversally to the slot.

In some embodiments, the distal end of the slot is closed by the end wall.

In some embodiments, the means include a peripheral wall circumscribing an entirety of a circumference of the slot.

In some embodiments, the vane arms are made of a composite material.

In some embodiments, the means include a distance between two opposite guiding walls of the slot decreasing below a diameter of the slider.

In some embodiments, the vane arm includes each of the vane arms.

In still yet another aspect, there is provided a variable guide vane assembly for a gas turbine engine, comprising: a unison ring rotatable about a central axis thereof, the unison ring having an array of circumferentially spaced-apart sliders; a set of variable guide vanes (VGV) circumferentially distributed around the central axis and mounted for rotation about respective spanwise axes of the VGVs; and vane arms operatively connected to respective VGVs of the set of VGVs for rotation therewith, the vane arms each defining a slot along a longitudinal direction of the vane arms, a corresponding slider of the array of circumferentially spaced-apart sliders captively received in the slot for movement therealong, the slot extending longitudinally from a first to a second end, the first and second ends at least partly closed by respective end walls providing an abutment surface for the corresponding slider.

DESCRIPTION OF THE DRAWINGS

Reference is now made to the accompanying figures in which.

DETAILED DESCRIPTION

The following disclosure relates generally to gas turbine engines, and more particularly to assemblies including one or more struts and variable orientation guide vanes as may be present in a compressor section of a gas turbine engine. In some embodiments, the assemblies and methods disclosed herein may promote better performance of gas turbine engines, such as by improving flow conditions in the compressor section in some operating conditions, improving the operable range of the compressor, reducing energy losses and aerodynamic loading on rotors.

Figure 1:
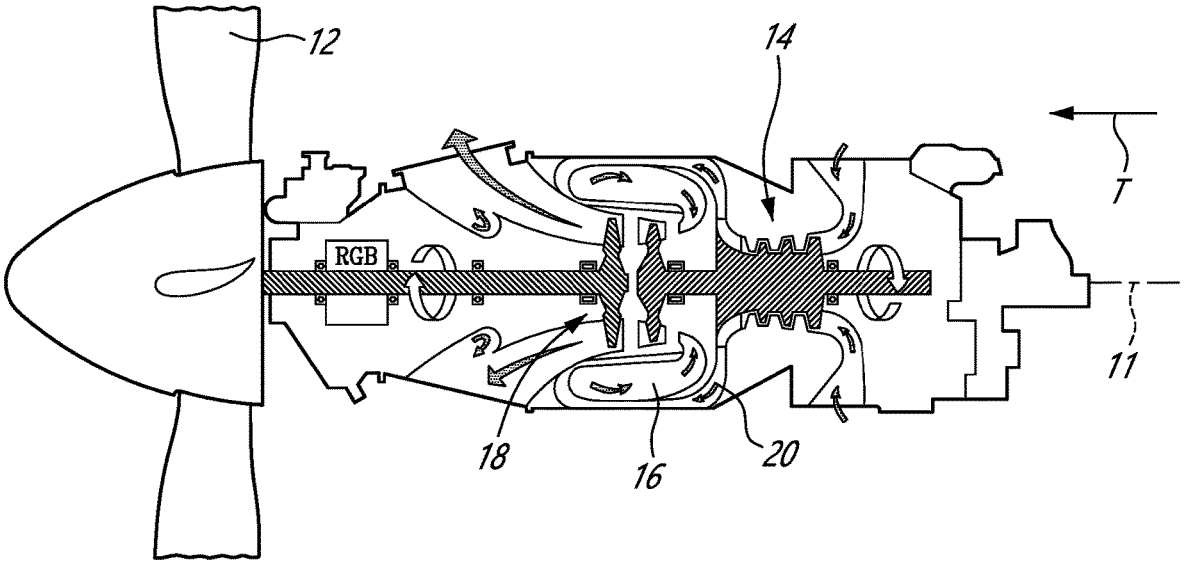
FIG. 1 is a schematic cross sectional view of a gas turbine engine.

FIG. 1 illustrates a gas turbine engine 10 of a type preferably provided for use in subsonic flight, and in driving engagement with a rotatable load, which is depicted as a propeller 12. The gas turbine engine has in serial flow communication a compressor section 14 for pressurizing the air, a combustor 16 in which the compressed air is mixed with fuel and ignited for generating an annular stream of hot combustion gases, and a turbine section 18 for extracting energy from the combustion gases.

It should be noted that the terms "upstream" and "downstream" used herein refer to the direction of an air/gas flow passing through an annular gaspath 20 of the gas turbine engine 10. It should also be noted that the term "axial", "radial", "angular" and "circumferential" are used with respect to a central axis 11 of the gaspath 20, which may also be a central axis of gas turbine engine 10. The gas turbine engine 10 is depicted as a reverse-flow engine in which the air flows in the annular gaspath 20 from a rear of the engine 10 to a front of the engine 10 relative to a direction of travel T of the engine 10. This is opposite than a through-flow engine in which the air flows within the gaspath 20 in a direction opposite the direction of travel T, from the front of the engine towards the rear of the engine 10. The principles of the present disclosure may apply to reverse-flow and through flow engines and to any other gas turbine engines, such as a turbofan engine and a turboprop engine.

Figure 2:
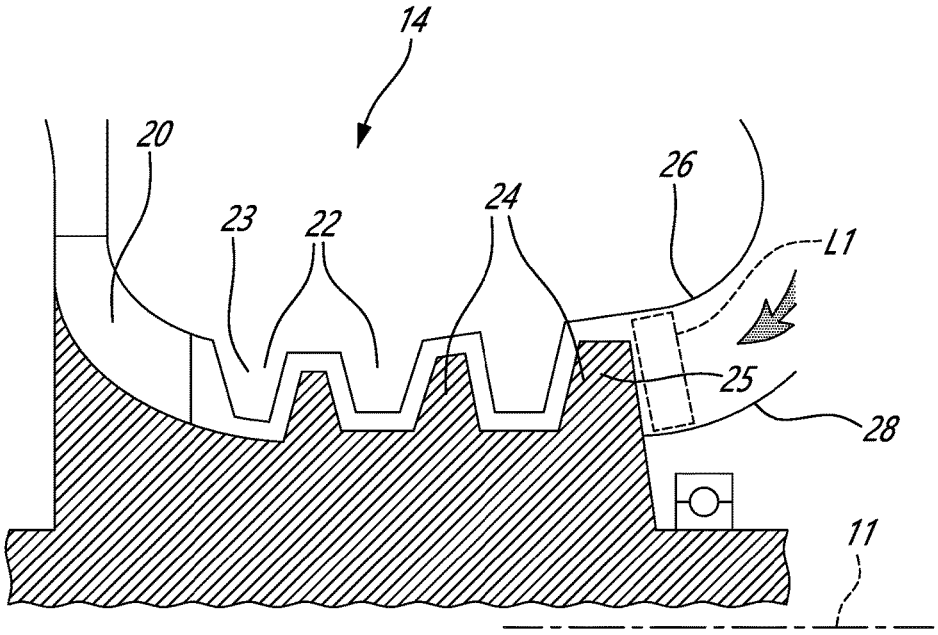
FIG. 2 is an enlarged view of a portion of FIG. 1.

Referring now to FIG. 2, an enlarged view of a portion of the compressor section 14 is shown. The compressor section 14 includes a plurality of stages, namely three in the embodiment shown although more or less than three stages is contemplated, each stage including a stator 22 and a rotor 24. The rotors 24 are rotatable relative to the stators 22 about the central axis 11. Each of the stators 22 includes a plurality of vanes 23 circumferentially distributed about the central axis 11 and extending into the gaspath 20. Each of the rotors 24 also includes a plurality of blades 25 circumferentially distributed around the central axis 11 and extending into the gaspath 20, the rotors 24 and thus the blades 25 thereof rotating about the central axis 11. As will be seen in further detail below, at least one of the stators 22 includes vanes 23 which are variable guide vanes (VGVs) and thus includes a variable guide vane assembly 40 as will be described.

In the depicted embodiment, the gaspath 20 is defined radially between an outer casing or wall 26 and an inner casing or wall 28. The vanes 23 and the blades 25 extend radially relative to the central axis 11 between the outer and inner casings 26, 28. "Extending radially" as used herein does not necessarily imply extending perfectly radially along a ray perfectly perpendicular to the central axis 11, but is intended to encompass a direction of extension that has a radial component relative to the central axis 11. The vanes 23 can be fixed orientation or variable orientation guide vanes (referred hereinafter as VGVs). Examples of rotors include fans, compressor rotors (e.g. impellers), and turbine rotors (e.g. those downstream of the combustion chamber).

Figure 3:
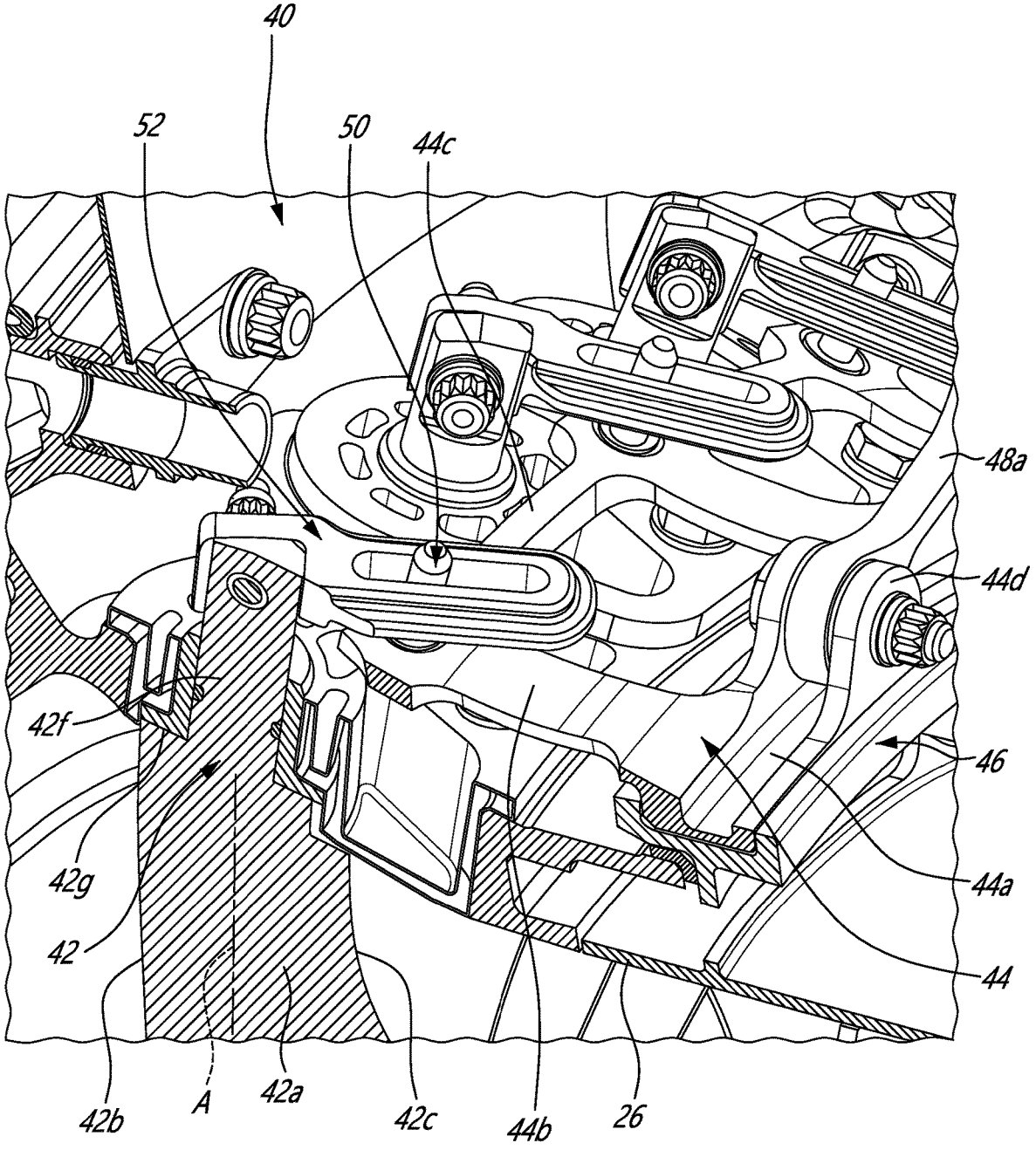
FIG. 3 is a three dimensional cutaway view of a portion of a variable guide vane assembly to be used with the engine of FIG. 1.

Referring to FIG. 3, an example of a variable guide vane (VGV) assembly of a stator 22 of the engine 10 is shown at 40. Any of the stators 22 of the compressor section 14 depicted in FIG. 2 may be embodied as a variable guide vane 40. It will be appreciated that, in some cases, the VGV assembly 40 may be used as a stator of the turbine section 18 of the engine 10 without departing from the scope of the present disclosure. The VGV assembly 40 may be located at an upstream most location L1 (FIG. 2) of the compressor section 14. That is, the VGV assembly 40 may be a variable inlet guide vane assembly.

The VGV assembly 40 includes a plurality of vanes 42, only one being illustrated in FIG. 3, circumferentially distributed about the central axis 11 and extending radially between the inner casing 28 (FIG. 2) and the outer casing 26. In the present embodiment, the vanes 42 are rotatably supported at both of their ends by the inner and outer casings 28, 26. Particularly, each of the vanes 42 has an airfoil 42*a* having a leading edge 42*b* and a trailing edge 42*c* both extending along a span of the airfoil 42*a*. Each of the vanes 42 has an inner stem (not shown), also referred to as an inner shaft portion, at an inner end of the airfoil 42*a* and an outer stem, also referred to as an outer shaft portion, 42*f*, at an outer end 42*g* of the airfoil 42*a*. The inner and outer stems may be rollingly engaged to the inner and outer casings, 28, 26, respectively. As shown in FIG. 3, the outer stems 42*f* are rollingly engaged within apertures defined through the outer casing 26. The vanes 42 are rotatable about respective spanwise axes A to change an angle of attack defined between the vanes 42 and a flow flowing within the annular gaspath 20. In the embodiment shown, the spanwise axes A extend between the inner and outer stems of the vanes 42.

Figure 4:
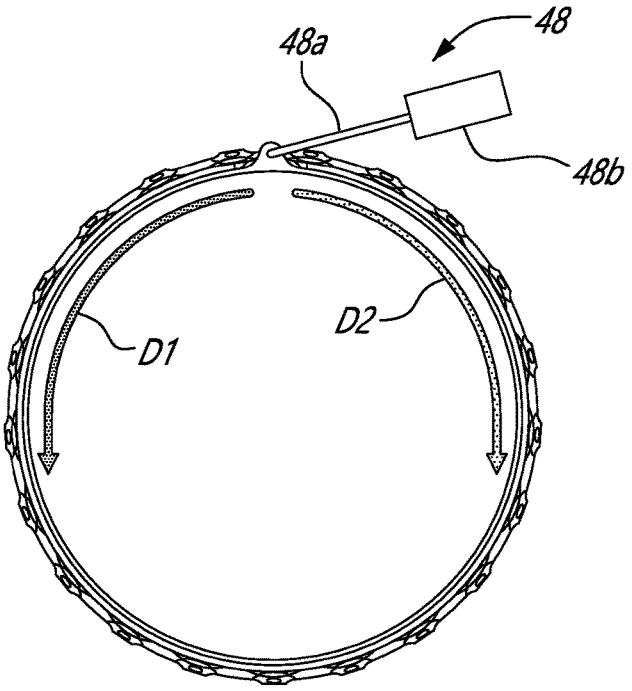
FIG. 4 is a front view of a unison ring of the variable guide vane assembly of FIG. 3.

Referring to FIGS. 3-4, the VGV assembly 40 includes a unison ring 44, also referred as a drive ring, that extends annularly all around the central axis 11. The unison ring 44 is used to convert a linear motion input into a rotational motion output. The unison ring 44 is used to synchronize the motion of the variable guide vanes 42 about their respective spanwise axes A. The unison ring 44 is rollingly engaged to the outer casing 26. Particularly, in the embodiment shown, a bushing 46 is secured to the outer casing 26, the unison ring 44 slides on the bushing 46 when the unison ring 44 rotates about the central axis 11. The bushing 46 constrains the unison ring 44 axially and radially relative to the central axis 11 such that the unison ring 44 moves solely circumferentially relative to the central axis 11. In the embodiment shown, the unison ring 44 has a first section 44*a* that is rollingly engaged to the bushing 46, connecting arms 44*b* that extend from the first section 44*a* in a direction having an axial component relative to the central axis 11, and a second section 44*c* that extends circumferentially all around the central axis 11. Hence, in the depicted embodiment, the first and second sections 44*a*, 44*c* of the unison ring 44 are connected to one another via the plurality of connecting arms 44*b* that are circumferentially interspaced around the central axis 11. In the embodiment shown, the first section 44*a*, the second section 44*c*, and the connecting arms 44*b* are all part of a monolithic single body. It will however be understood that, in an alternate embodiment, the unison ring 44 may be made of a plurality of separate sections secured to one another.

The unison ring 44 defines attachment flanges 44*d* that are used to secure a movable member 48*a* of an actuator 48 (FIG. 4). Although two flanges 44*d* are used in the embodiment shown for receiving therebetween an end of the movable member 48*a* of the actuator 48, only one flange 44*d* may be used. The actuators 48 may be secured to the outer casing 26 and operable to move the movable member 48*a* along its longitudinal axis. In so doing, the unison ring 44 rotates around the central axis 11 along direction D1 or D2 depending if the movable member 48*a* is extended or retraced from a body 48*b* of the actuator 48.

As illustrated in FIG. 3, the VGV assembly 40 includes sliders, also referred to as driving pins, 50 that are secured to the unison ring 44. The sliders 50 may be secured to the unison ring 44 by being monolithic with the unison ring 44. In the present case, the sliders 50 are separate components secured (e.g., threaded, welded, etc) to the second section 44*c* of the unison ring 44 and each of the sliders 50 is circumferentially aligned with a respective one of the connecting arms 44*b*. Providing the unison ring 44 with the first and second sections 44*a*, 44*b* connected together with the connecting arms 44*c* may increase rigidity while minimizing weight. A grid or truss structure may be used. Each of the sliders 50 extends from the unison ring 44 along a direction having a radial component relative to the central axis 11.

The VGV assembly 40 includes vane arms 52. Each of the vane arms 52 is secured to a respective one of the outer stems 42*f* of the vanes 42 and extends substantially transversally away from the outer stems 42*f*. That is, each of the vane arms 52 extends in directions having a radial component relative to its spanwise axis A of the vanes 42. The vane arms 52 are engageable by the sliders 50 to rotate the vanes 42 about their respective spanwise axes A. That is, rotation of the unison ring 44 about the central axis 11 moves the sliders 50 circumferentially relative to the central axis 11. This causes the sliders 50 to pivot the vane arms 52 and the vanes 42 secured thereto about the respective spanwise axes A of the vanes 42 for changing the angle of attacks defined between the vanes 42 and the flow flowing within the annular gaspath 20.

This present disclosure describes a method to prevent the vane arm and the sliders from losing contact during any point of the drive ring rotational stroke. If contact between these two components is lost, the guide vanes may no longer be rotationally constrained which may cause interruptions in the gaspath. More specifically, if the sliders 50 become disengaged from the vane arms 52, the rotation of the vanes 42 about their respective spanwise axes A is no longer constrained by the unison ring 44 and the sliders 50 and, in some conditions, they may rotate to become substantially transverse to the flow flowing into the annular gaspath 20, which may deter performance of the engine 10.

Figure 5:
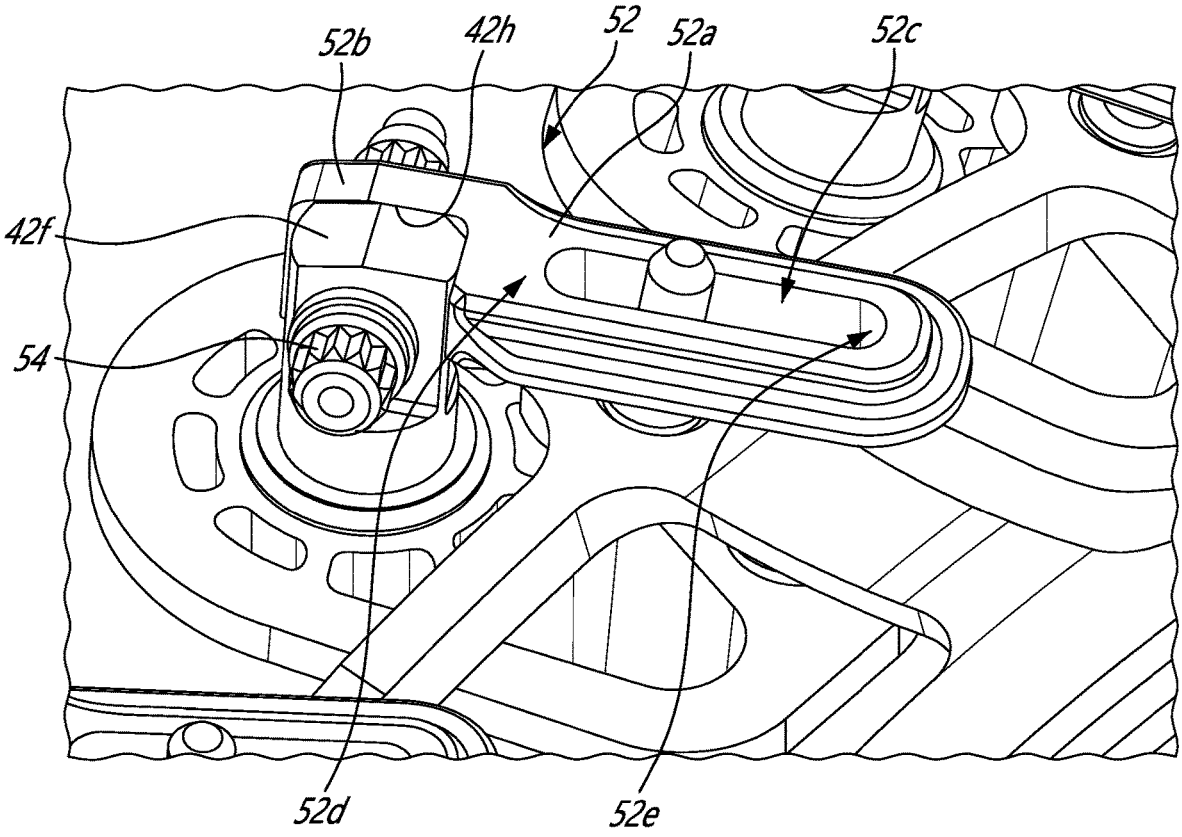
FIG. 5 is an enlarged view of a portion of FIG. 3 illustrating a vane arm used for pivoting a respective one of variable guide vanes of the variable guide vane assembly of FIG. 3.

Referring now to FIG. 5, the arms 52 are described herein below. Since the below description may apply to all of the arms 52, only one of the arms 52 is described below using the singular form. It is understood that this description below applies to all of the arms 52 of the VGV assembly 40. In the embodiment shown, the vane arms 52 are closed vane arm that completely trap the sliders 50. The motion of the sliders 50 is therefore constrained inside the vane arms 52 to avoid loss of contact between the sliders 50 and the vane arms 52 at any point in the unison ring rotational motion about the central axis 11. The sliders 50 move linearly along the vane arms 52 and are stopped at either extreme ends of the unison ring actuation.

The arm 52 has a main section 52*a* and a flange 52*b* secured to the main section 52*a*. The flange 52*b* is used to secure the arm 52 to the outer stem 42*f* of one of the vanes 42. In the depicted embodiment, a distal portion of the outer stem 42*f* defines a flat surface 42*h* that is in abutment against the flange 52*b* of the arm 52. A fastener 54 extends through registering apertures defined by the flange 52*b* and the distal portion of the outer stem 42*f* of the vane 42. Although only one flange is shown, the arm 52 may have two flanges spaced apart to receive the distal portion of the outer stem 42*f* of the vane 42. In other words, the outer stem 42*f* of the vane 42 may be sandwiched between the two flanges of the vane arm 52.

Figure 6:
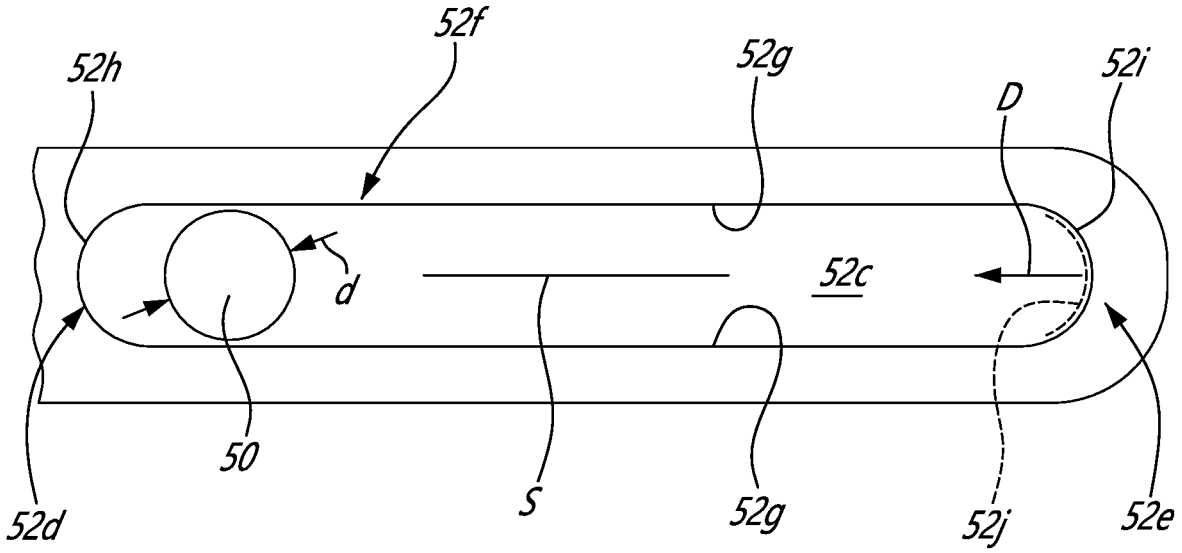
FIG. 6 is a schematic top view of a portion of one of the vane arms of the variable guide vane assembly of FIG. 3.

Referring to FIGS. 5-6, the main section 52*a* of the arm 52 defines a slot 52*c* that extends along a slot axis S from a proximal end 52*d* to a distal end 52*e* relative to a distance from the outer stem 42*f*. The distal end 52*e* is radially outward of the proximal end 52*d* relative to the spanwise axis A. The slot 52*c* is sized to receive the slider 50 in the slot 52*c*. The main section 52*a* of the arm 52 has a peripheral wall 52*f* circumscribing the slot 52*c*. The peripheral wall 52*f* defines two guiding walls 52*g* being opposite one another, a proximal end wall 52*h* at the proximal end 52*d* and a distal end wall 52*i* at the distal end 52*e*. A distance between the two guiding walls 52*g* correspond to a diameter d (FIG. 6) of the slider 50. The slider 50 is in contact with the two guiding walls 52*g* as it rides along the slot axis S within the slot 52*c* following movements of the unison ring 44. The slot axis S may be considered as a mid-line extending along the slot 52*c* from the proximal end 52*d* to the distal end 52*e* and being centered between the opposite guiding walls 52*g* of the peripheral wall 52*f* of the slot 52*c*. That is, if the slot 52*c* were curved, so would be the slot axis S.s In the embodiment shown, the slot 52*c* is surrounded all around its circumference by the peripheral wall 52*f*. In other words, the slot 52*c* is closed at both of its proximal and distal ends 52*d*, 52*e* by the proximal end wall 52*h* and the distal end wall 52*i*. This may allow the sliders 50 to remain engaged by the arm 52 within the slot 52*c* regardless of the movements of the unison ring 44. More specifically, the arm 52 defines an abutment surface 52*j* (shown in dashed line in FIG. 6) at the distal end 52*e*. The abutment surface 52*j* is defined by the distal end wall 52*i*. The abutment surface 52*j* faces toward the proximal end 52*d* along a direction D that has an axial component relative to the slot axis S. Stated differently, the distal end wall 52*i* extends in a direction having a component transverse to the slot axis S. The distal end wall 52*i* therefore substantially close the distal end 52*e* of the slot 52*c*. As used in the present disclosure, "substantially close" means that although an opening may be present at the distal end 52*e* of the slot 52*c*, this opening is smaller than the diameter d (FIG. 6) of the slider 50 such that the slider 50 cannot exit the slot 52*c* via this opening.

When the slider 50 reaches the distal end 52*e* of the slot 52*c*, it abuts against the distal end wall 52*i* and, thus, the abutment surface 52*j* prevents the slider 50 from exiting the slot 52*c* and prevents the slider 50 from becoming disengaged from the arm 52. The slider 50 is movable within the slot 52*c* along the slot axis S from a first position between the proximal and distal ends 52*d*, 52*e* of the slot 52*c* and a second position in which the slider 50 is located at the distal end 52*e* of the slot 52*c* and in contact against the abutment surface 52*j* and the distal end wall 52*i*. In the second position, further movements of the slider 50 away from the proximal end 52*d* are blocked by the distal end wall 52*i*. The slider 50 may be at a third position in which the slider 50 is located at the proximal end 52*d* of the slot 52*c* and in abutment against the proximal end wall 52*h*. The proximal end wall 52*h* thereby limits further movements of the slider 50 away for the distal end 52*e* of the slot 52*c* since the proximal end wall 52*h* extends in a direction having a component transverse to the slot axis S.

It will be appreciated that any suitable vane arm having a means for limiting movements of the sliders 50 out of the slots 52*c* is contemplated without departing from the scope of the present disclosure. These means may include, for instance, the end walls described above extending in a direction transverse to the slot axes S, a stopper fastened to the main section 52*a* of the vane arm 52 to substantially close the distal end 52*e* of the slot, protrusions extending from the guiding walls 52*g* toward one another across the slot 52*c*, a decrease in a width of the slot 52*c* taken along the direction transverse to the slot axis S until the width becomes less than the diameter of the slider 50.

Other configurations use a limiting feature on the surrounding geometry to prevent the vane arm from losing contact with the slider. This limiting feature includes, for instance, a bearing secured to the unison ring and two stoppers secured to the outer casing; the bearing in abutment against the two stoppers at end positions of the unison ring to prevent disengagement of the sliders from the slots of the vane arms. The vane arm 52, more specifically the slider 50 enclosed within the vane arm 52, allows to avoid using a distinct system for delimiting the movements of the unison ring. Part count reductions and weight savings may therefore be achieved using the vane arm 52 of the present disclosure.

The vane arm 52 may be manufactured from compression molding composite materials. For instance, the vane arm 52 may be made of polyamide with 40% carbon fill. Any other suitable composite material may be used. Other materials may be used, such as, graphite, Teflon™, metallic materials, metallic materials impregnated with oil/graphite. Any suitable material that meets the mechanical properties requirements may be used. Materials having tribology properties, such as self-lubricating materials, may be used. The unison ring 44 and/or the driving pins 50 may be made of compression molding composite materials. Moreover, a greater structural stiffness (for an equivalent material and part thickness) may be achieved for the vane arms by having the distal ends 52*e* of the slots 52*c* fully closed. In some cases, open-ended slots offer less stiffness than closed-ended slots, which may result in distortion when the arms with open-ended slots come out of their mold. This distortion may mean that there is less contact between the vane arm and the sliders, which my increase wear on these components. This distortion problem may be absent by using the disclosed vane arms 52 with closed-ended slots 52*c*. This productivity benefit of the closed-ended vane arm design may increase the amount of usable parts from manufacturing. The increased stiffness of the disclosed arms 52 may provide dynamics benefits, such as a reduction in vibrations, and may increase the accuracy of the transfer motion from the unison ring 44 to the variable guide vanes 42. This stiffness improvement may also correct a problem that occurs for open-ended vane having two flanges for securing to the outer stem 42*f*: when the vane connection is tightened, it tends to increase a dimension of the opening at the open-end of the slot. Having the slot 52*c* of the vane arm 52 being close-ended may address this problem.

For varying angles of attacks defined by the variable guide vanes 42, the vanes 42 are rotated about the spanwise axes A by rotating the unison ring 44 about the central axis 11, and by moving the sliders 50 of the unison ring 44 along the slots 52*c* defined by the arms 52 secured to the first stems 42*f* of the variable guide vanes 42; and rotation of the unison ring 44 about the central axis 11 is prevented by abutting the sliders 50 against the end walls 52*i* of the arms 52.

The vane assembly 40 has been described as including a plurality of vane arms 52 each defining a slot substantially closed at its distal end. However, it is understood that, in an alternate embodiment, only one of the slots of the vane arms may be substantially closed, by the distal end wall or other suitable means. That is, only one of the vane arms 52 may be used to stop further rotation of the unison ring 44 to prevent the sliders 50 from becoming disengaged from their respective vane arms. Any suitable number of vane arms 52 may be able to block their respective sliders 50 from exiting their respective slots. All of the vane arms 52 may be able to block their respective sliders 50 from exiting their respective slots.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, although the unison ring and the vane arms have been described as being located at radially outer ends of the variable guide vanes, they may be located at the radially inner ends of the variable guide vanes. The unison ring may be therefore rollingly engaged to the inner case instead of to the outer case. Yet further modifications could be implemented by a person of ordinary skill in the art in view of the present disclosure, which modifications would be within the scope of the present technology.

The invention claimed is:

1. A variable guide vane (VGV) assembly for a gas turbine engine, comprising:

variable guide vanes circumferentially distributed about a central axis, the variable guide vanes having airfoils extending between first and second stems at respective first and second ends of the airfoils, the variable guide vanes rotatable about respective spanwise axes;

a unison ring rotatable about the central axis, the unison ring having a first section slidably engageable to a casing of the gas turbine engine, the first section having connecting arms that extend from the first section in a direction having an axial component relative to the central axis, and a second section secured to the connecting arms, the first section axially offset from the second section relative to the central axis;

sliders protruding from the second section of the unison ring and circumferentially distributed around the central axis; and vane arms engaged to the first stems of the variable guide vanes, the vane arms defining respective slots, each of the slots extending in a direction having a radial component relative to a respective one of the spanwise axes, the sliders received within respective ones of the slots, a slot of the slots extending from a proximal end adjacent a corresponding one of the first stems to a distal end along a slot axis, the slot defined by a vane arm of the vane arms, the vane arm having an end wall at the distal end of the slot, the end wall extending in a direction having a component transverse to the slot axis such that a slider of the sliders is in abutment against the end wall when the slider is at the distal end to prevent the sliders from moving out of the slots.

2. The VGV assembly of claim 1, wherein the slider is movable along the slot axis from a first position in which the slider is between the proximal and distal ends and a second position in which the slider is at the distal end in contact against the end wall and in which further movements of the slider away from the proximal end are blocked by the end wall.

3. The VGV assembly of claim 1, wherein the slot is fully enclosed by a peripheral wall of the vane arm, the peripheral wall including the end wall.

4. The VGV assembly of claim 3, wherein the peripheral wall defines two opposite guiding walls, the slider in contact with the two opposite guiding walls between the proximal and distal ends of the slot.

5. The VGV assembly of claim 4, wherein the slider rides within the slot along the two opposite guide walls, a distance between the two opposite guiding walls substantially corresponding to a diameter of the slider.

6. The VGV assembly of claim 1, wherein the vane arms are made of a composite material.

7. The VGV assembly of claim 1, wherein each of the vane arms includes a respective one of the slots.

8. A gas turbine engine, comprising:

an annular gaspath extending around a central axis, the annular gaspath defined between a first casing and a second casing; and a variable guide vane assembly having variable guide vanes circumferentially distributed about the central axis, the variable guide vanes having airfoils extending between first and second stems at respective first and second ends of the airfoils, the variable guide vanes rotatable about respective spanwise axes, a unison ring rotatable about the central axis, the unison ring having a first section slidably engaged to the first casing for rotation about the central axis, the first section having connecting arms that extend from the first section in a direction having an axial component relative to the central axis, and a second section secured to the connecting arms, the first section axially offset from the second section relative to the central axis, sliders protruding from the unison ring and circumferentially distributed around the central axis, and vane arms engaged to the first stems of the variable guide vanes, the vane arms defining slots, each of the slots extending in a direction having a radial component relative to a respective one of the spanwise axes, the sliders engaged to the vane arms by being received within the slots, a slot of the slots being substantially enclosed by a peripheral wall of a respective vane arm, the sliders prevented from exiting the slots via an abutment between a slider of the sliders and the peripheral wall at a distal end of the slot of the vane arm.

9. The gas turbine engine of claim 8, wherein the slot is entirely circumscribed by the peripheral wall of the vane arm.

10. The gas turbine engine of claim 8, wherein the peripheral wall defines two opposite guiding walls, the slider in contact with the two opposite guiding walls between a proximal end of the slot and the distal end of the slot.

11. The gas turbine engine of claim 8, wherein the first casing is located radially outwardly of the second casing relative to the central axis.

12. The gas turbine engine of claim 8, wherein the vane arms are made of a composite material.

13. The gas turbine engine of claim 8, wherein each of the vane arms includes a respective one of the slots.

14. A variable guide vane (VGV) assembly for a gas turbine engine, comprising:

variable guide vanes circumferentially distributed about a central axis, the variable guide vanes having airfoils extending between first and second stems at respective first and second ends of the airfoils, the variable guide vanes rotatable about respective spanwise axes, a unison ring rotatable about the central axis and relative to a casing of the gas turbine engine, the unison ring having a first section slidably engageable to the casing of the gas turbine engine, the first section having connecting arms that extend from the first section in a direction having an axial component relative to the central axis, and a second section secured to the connecting arms, the first section axially offset from the second section relative to the central axis;

sliders protruding from the second section of the unison ring and circumferentially distributed around the central axis; and vane arms secured to the first stems of the variable guide vanes, the vane arms defining slots, each of the slots extending in a direction having a radial component relative to a respective one of the spanwise axes, the sliders engaged to the vane arms by being received within the slots, a vane arm of the vane arms having means for preventing the sliders from exiting the slots of the vane arms.

15. The VGV assembly of claim 14, wherein the means include an end wall of the vane arm at a distal end of a slot of the slots, the end wall extending transversally to the slot.

16. The VGV assembly of claim 15, wherein the distal end of the slot is closed by the end wall.

17. The VGV assembly of claim 14, wherein the means include a peripheral wall circumscribing an entirety of a circumference of the slot.

18. The VGV assembly of claim 14, wherein the vane arms are made of a composite material.

19. The VGV assembly of claim 14, wherein the means include two opposite guiding walls of the slot extending toward one another until a distance between the two opposite guiding walls becomes below a diameter of the slider.

20. The VGV assembly of claim 14, wherein each of the vane arms includes a respective one of the slots.

* * * * *